US007494354B2

(12) United States Patent
Mon et al.

(10) Patent No.: US 7,494,354 B2
(45) Date of Patent: Feb. 24, 2009

(54) CARD EDGE CONNECTOR WITH EJECTOR

(75) Inventors: Chi-Dung Mon, Tu-Cheng (TW); Xue-Wu Bu, Kunshan (CN); Yuh-Huey Kang, Tu-Cheng (TW); De-Xi Chen, Kunshan (CN); Jian Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/880,921

(22) Filed: Jul. 25, 2007

(65) Prior Publication Data

US 2008/0026618 A1 Jan. 31, 2008

(51) Int. Cl.
*H01R 13/62* (2006.01)

(52) U.S. Cl. ..... 439/160; 439/157

(58) Field of Classification Search ..... 439/157, 439/160, 327, 328

See application file for complete search history.

(56) References Cited

U.S. PATENT DOCUMENTS 5,746,614 A 5/1998 Cheng et al.
2004/0248444 A1* 12/2004 Zhao et al. ..... 439/157

* cited by examiner

*Primary Examiner*—Ross N Gushi
(74) *Attorney, Agent, or Firm*—Wei Te Chung

(57) ABSTRACT

A card edge connector includes an elongated insulative housing, a number of electrical contacts received therein and an ejector rotatably mounted thereon. The insulative housing defines a central slot for receiving a card therein. At least one tower is formed at one end of the insulative housing and includes a pair of sidewalls. The ejector includes a main body with a kicker at a bottom end and a handle at a top end thereof. Each sidewall of the tower includes a first bar and a second bar engaging with a first protrusion disposed on the ejector thereby generating a two-segment interference between the ejector and the insulative housing.

13 Claims, 6 Drawing Sheets

CARD EDGE CONNECTOR WITH EJECTOR

BACKGROUND OF THE INVENTION

1. Field of the Invention

The present invention is related to a card edge ejector, and particularly to the DDR (Double Data Rate) connector having the ejector on opposite ends thereof.

2. Description of Related Art

U.S. Pat. No. 5,746,614 discloses a card edge connector having ejectors at two opposite ends for ejecting the DDR module therein. The ejector includes a main body with a kicker at a bottom portion and a handle at a top portion thereof. A pair of retention protrusions is formed on the opposite ends of the main body to resist wear thereby keeping good retention function between the DDR module and the ejector. Unfortunately, the retention protrusion is easy to unloose by the concussion. Furthermore, the retention protrusion can be distorted during the process of high temperature. Therefore, the ejector can't provide sufficient retention force to ensure the DDR module received in the connector firmly.

Hence, an improved card edge connector is required to overcome the disadvantages of the prior art.

BRIEF SUMMARY OF THE INVENTION

Accordingly, an object of the present invention is to provide a card edge connector having protrusions thereon for efficiently retaining the ejector in the housing of the connector.

In order to obtain the object, a card edge connector comprises an elongated insulative housing, a plurality of electrical contacts and an ejector. The insulative housing defines a central slot for receiving a card therein and a plurality of passageways disposed on two side of the central slot for receiving the electrical contacts therein. At least one tower is formed at one end of the insulative housing and includes a pair of sidewalls and a receiving space formed therebetween. The ejector is received within the tower and includes a main body with a kicker at a bottom end and a handle at a top end thereof. Each sidewall of the tower includes a first bar and a second bar engaging with a first protrusion disposed on the ejector thereby generating a two-segment interference between the ejector and the insulative housing. The sidewall further comprises a third bar below the first and the second bars, and the ejector comprises a second protrusion on the main body thereof for interference with the third bar.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
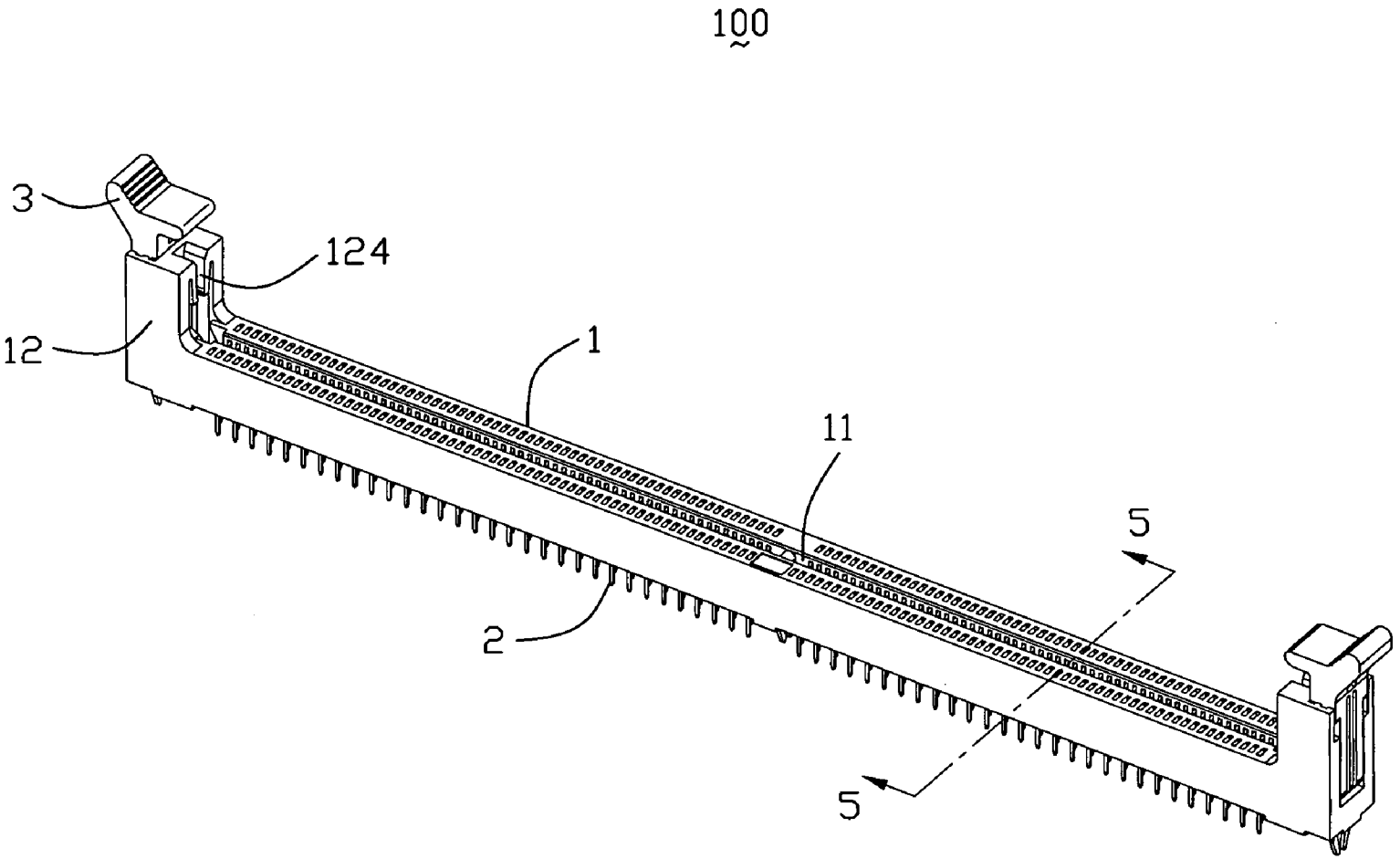
FIG. 1 is a perspective view of a card edge connector in accordance with the present invention.
Figure 2:
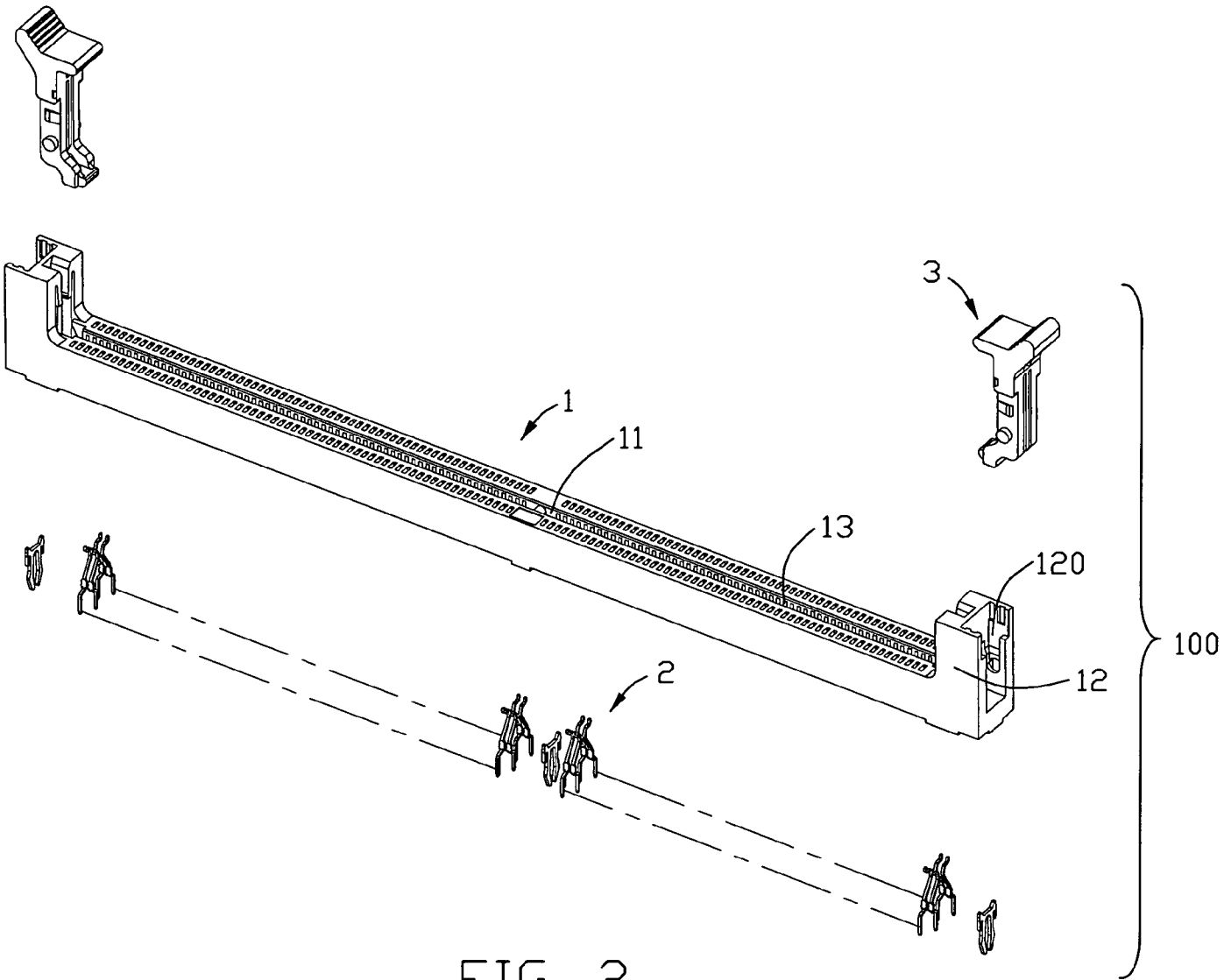
FIG. 2 is an exploded view of the card edge connector shown in FIG. 1.

Referring to FIGS. 1-6, a card edge connector 100 in accordance with the present invention for mounting to an printed circuit board (not shown) includes an insulative housing 1, a plurality of electrical contacts 2, and a pair of ejectors 3 rotatably located at opposite ends of the insulative housing 1. The insulative housing 1 includes a central slot 11 for receiving a memory card (not shown) therein and a pair of mounting portions or towers 12 at opposite ends thereof. A plurality of passageways 13 are positioned at two sides of the central slot 11 for receiving the electrical contacts 3 therein. Each electrical contact 2 includes retention portion 22 engaging with the passageways, an mating portion 21 extending from one end of the retention portion and projecting into the central slot 11, and a solder portion 23 extending from the other end of the retention portion 22 and out of the insulative housing 1.

Figure 3:
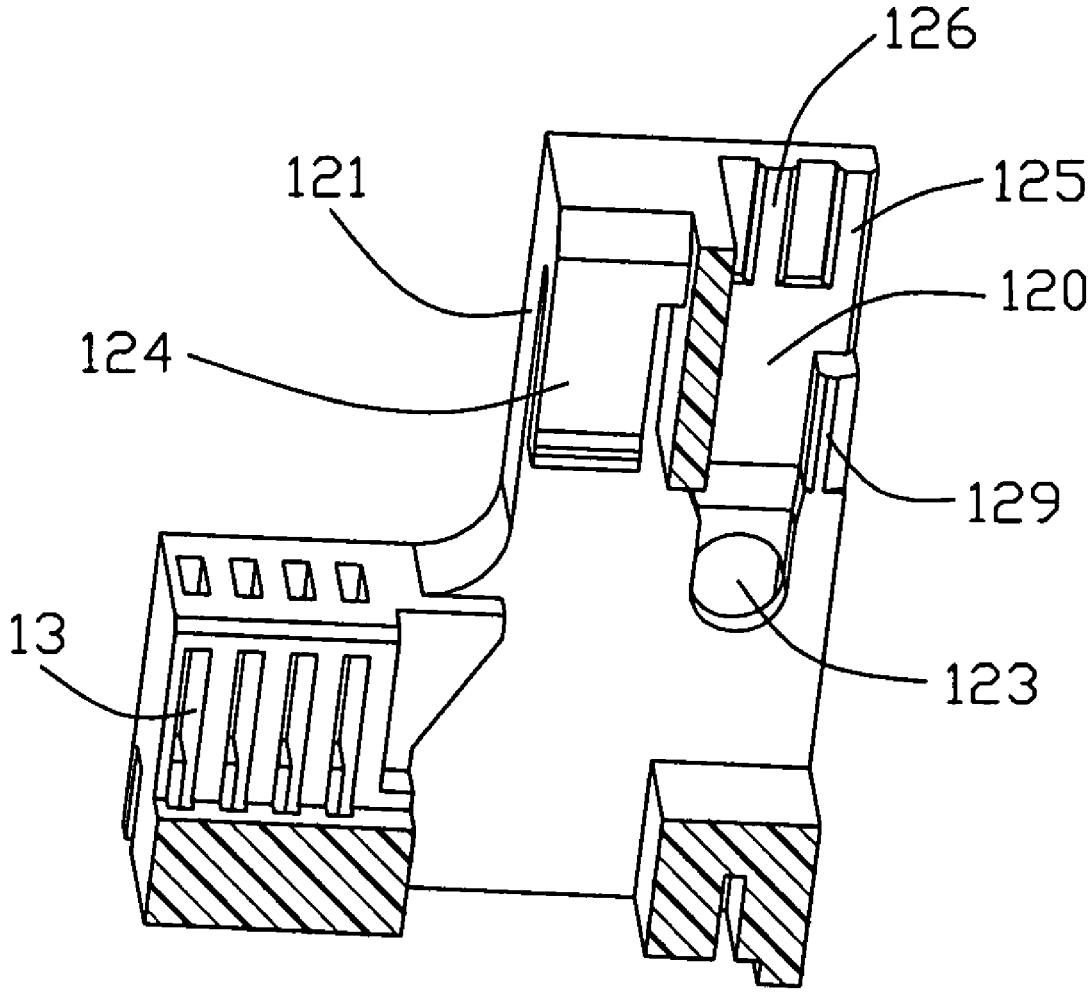
FIG. 3 is a partial cross-sectional view of one end of the insulative housing shown in FIG. 1.
Figure 6:
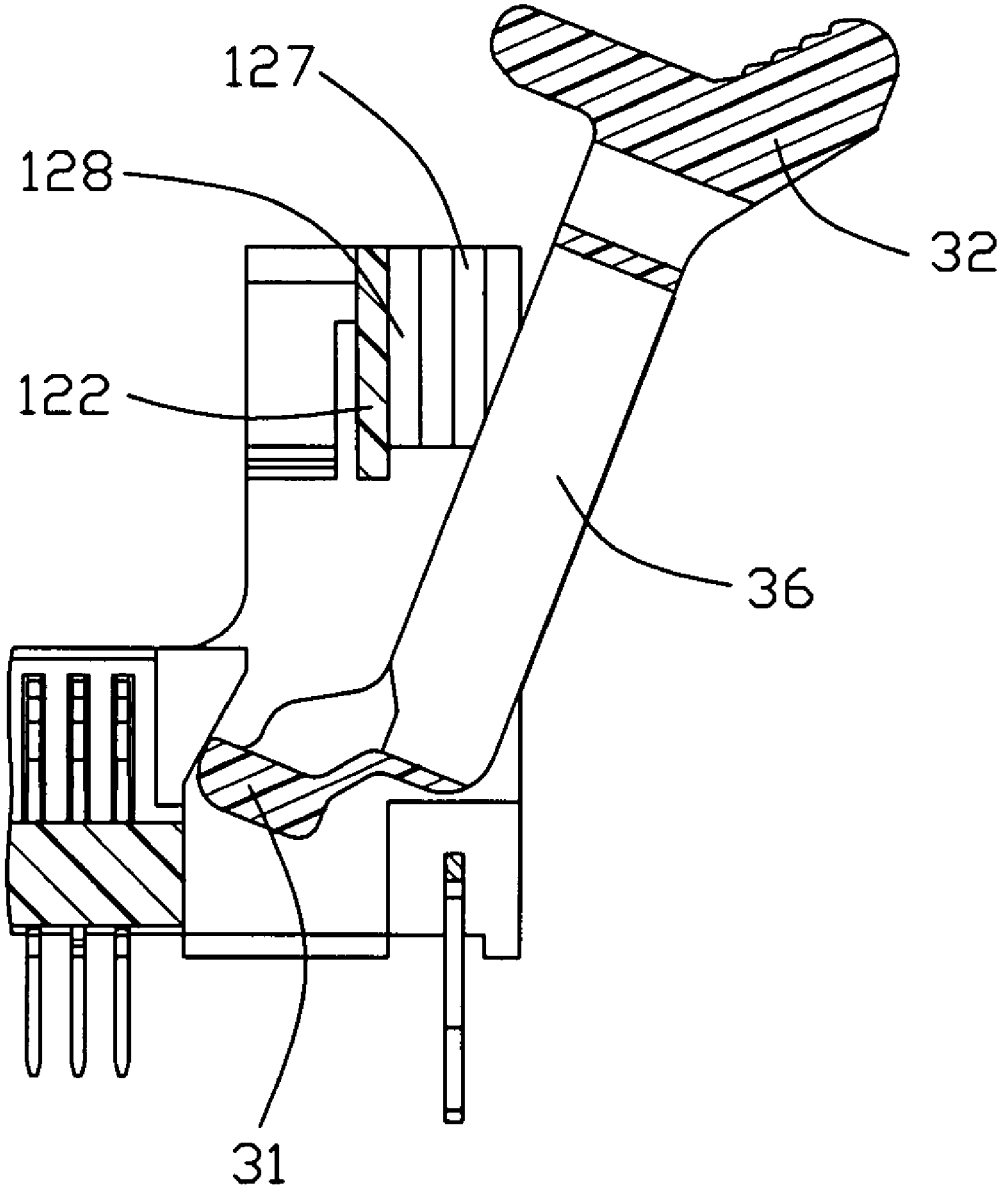
FIG. 6 is a partial cross-sectional view of one end of the insulative housing shown in FIG. 1, together with a side view of the corresponding ejector of FIG. 1.

Referring to FIGS. 3 and 6, each tower 12 includes a pair of sidewalls 121 and an enforcement wall 122 located therebetween. The pair of sidewalls 121 and the enforcement wall 122 define a receiving space 120 for receiving the ejector 3 therein. A pair of holes 123 horizontally extends through the pair of endwalls 121 respectively at a lower portion of thereof and located at one side of the enforcement wall 122. A pair of spring arms 124 extends downwardly from a top face of the sidewalls 121 respectively and located at the other side of the enforcement wall 122 for sandwiching the memory card therein. Each sidewall 121 has a first bar 125 and a second bar 126 along a left to right direction of the insulative housing 1. A first recess 127 and a second recess 128 are defined on the sidewall 121. The bars 125, 126 and the recesses 127, 128 are juxtaposed on the top end of the sidewall wherein the first recess 127 is located between the first bar 125 and the second bar 126. Each sidewall 121 further includes a third bar 129 extending beyond the first and second bars 125, 126 in a front to back direction and located between the first bar 125 and the hole 123 in an up to down direction.

Figure 4:
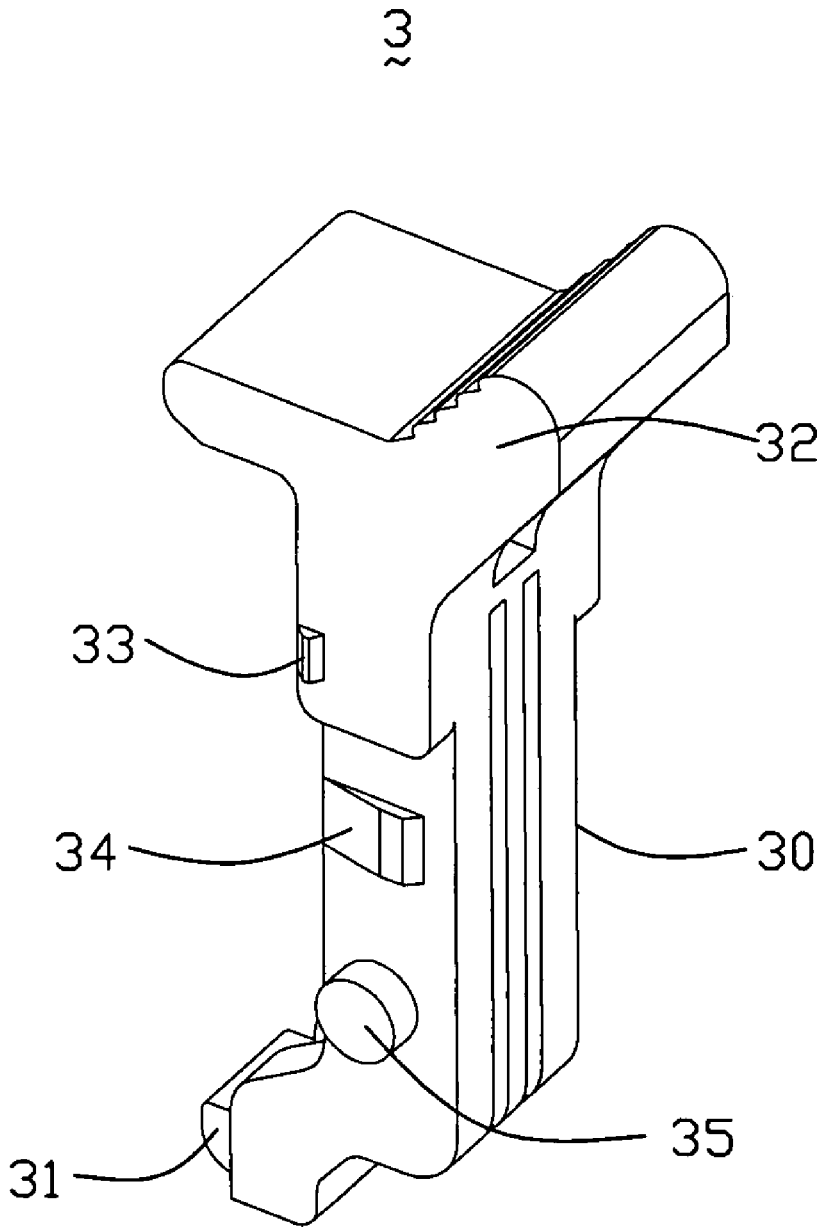
FIG. 4 is a perspective view of the ejector shown in FIG.1.
Figure 5:
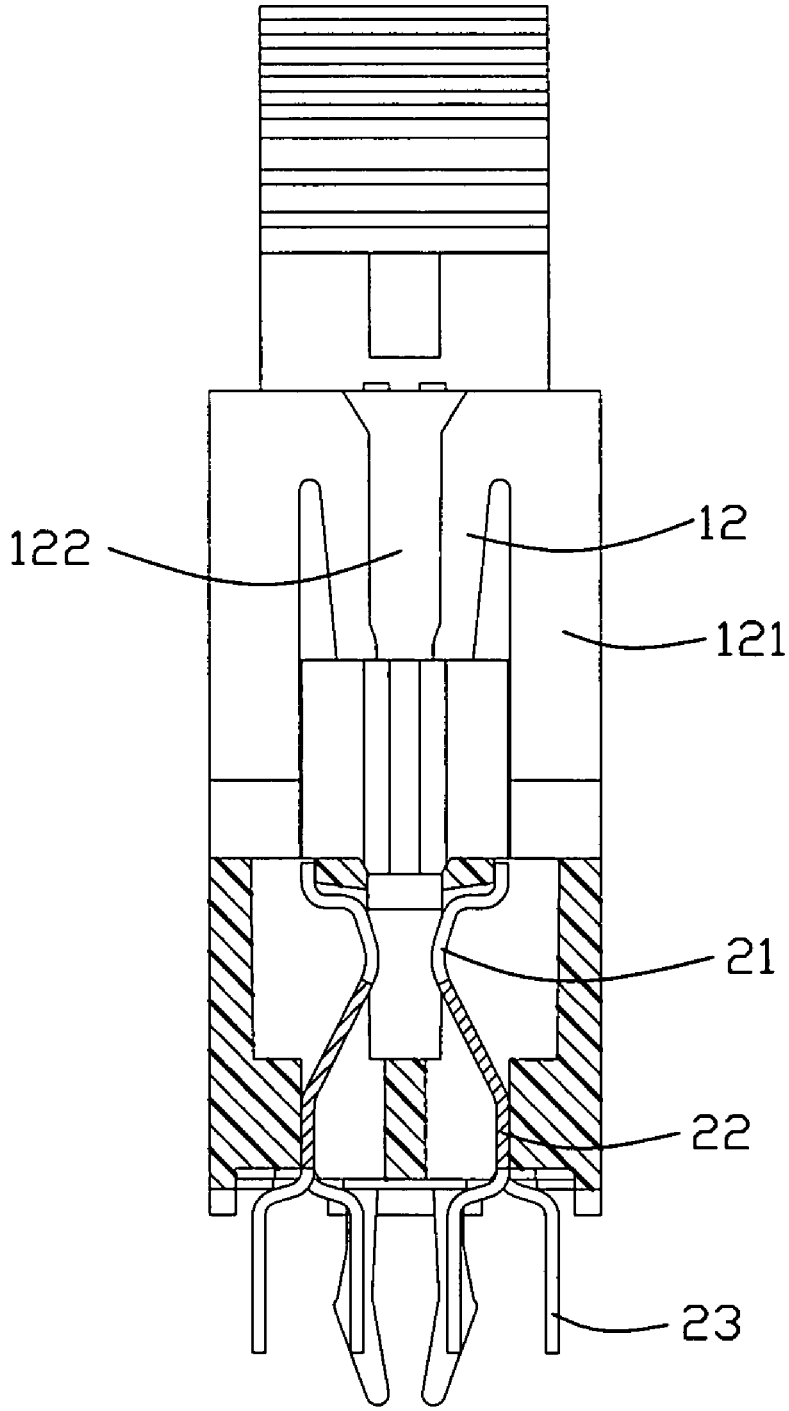
FIG. 5 is a cross-sectional view of the card edge connector taken along the line 5-5 shown in FIG. 1.

Correspondingly, referring to FIGS. 4 and 6, the ejector 3 includes an elongated main body 30 with a kicker 31 at a bottom end thereof and a handle/locker 32 at a top end thereof. A slot 36 extends along almost the whole lengthwise dimension of the main body 30 of the ejector 3 and extends therethrough in the left to right direction. The handle 32 includes a pair of first protrusions 33 at a lower end thereof for mating with the first and the second bars 125, 126. A pair of second protrusions 34 is generally positioned at a middle portion of each side face of the main body 30 for cooperation with the third bars 129 of the sidewalls 121. A spindle 35 is disposed on the main body 30 about the mid-point between the second protrusions 129 and the kicker 31. The first and the second protrusions 33, 34 are of a trapezoid shape including a slanted surface facing to the central slot 11. The first protrusion 33 is smaller than the second protrusions 34 and staggered therewith in the left to right direction.

Referring to FIGS. 3, 4 and 6, when operated, the ejector 3 has its spindles 35 received within the corresponding holes 123 so that the ejector 3 can be rotated with regard to the insulative housing 1. During the insertion of the memory card, the first and the second protrusions 33, 34 mate with the first and the third bar 125, 129 respectively. With the further rotation of the ejector 3, the second protrusions 34 pass by the third bars 129 to be received in the receiving space 120. The first protrusions 33 pass by the first recesses 127 and the second bars 12 in turn, and to be received in the second recesses 128 finally. The first protrusions 33 engage with the second bars 126 and the first bar 125 in turn thereby generating a two-segment interference between the ejector 2 and the insulative housing 1. Except the engagement between the second protrusions 34 and the third bars 129, the two segment interference can prevent the movement of the ejector 3 and further improves the reliability of the electrical connection between the card edge connector 100 and the memory card.

It should be noted that the first protrusion 33 are generated by the first and second bars 125, 126, but it is within the scope of the invention that the bars can be other structure so as to generate the interference between the ejector 3 and the insulative housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector, comprising:

an elongated insulative housing defining a central slot for receiving a card therein, a plurality of passageways disposed on two side of the central slot for receiving a plurality of electrical contacts therein;

at least one tower formed at one end of the insulative housing, said tower including a pair of sidewalls and a receiving space formed therebetween;

an ejector adapted to be received within the tower, said ejector including a main body with a kicker at a bottom end and a handle at a top end thereof; and wherein each sidewall of the tower includes a first bar and a second bar engaging with a first protrusion disposed on the ejector for generating a two-segment interference between the ejector and the insulative housing.

2. The card edge connector as claimed in claim 1, wherein the first and second bars are juxtaposed on the sidewalls at a top end thereof, and wherein the first protrusion is on a lower end of the handle.

3. The card edge connector as claimed in claim 2, wherein each sidewall further defines two recesses which being alternatively arranged with the first and the second bars.

4. The card edge connector as claimed in claim 1, wherein each sidewall includes a hole extending therethrough at a lower end thereof, and the ejector including a pair of spindles received in the holes.

5. The card edge connector as claimed in claim 1, wherein each sidewall further comprises a third bar below the first and the second bars, and the ejector comprising a second protrusion on the main body thereof for interference with the third bar.

6. The card edge connector as claimed in claim 1, wherein the tower further comprises a pair of spring arms for sandwiching a card.

7. The card edge connector as claimed in claim 1, wherein the first, the second and the third bars are staggered on the sidewall along a left to right direction of the insulative housing.

8. A card edge connector, comprising:

an elongated insulative housing defining a central slot for receiving a card therein, a plurality of passageways disposed on two side of the central slot for receiving a plurality of electrical contacts therein;

at least one tower formed at one end of the insulative housing, said tower including a pair of sidewalls and a receiving space formed therebetween;

an ejector received in the receiving space and rotatably mounting on the tower, said ejector including a main body with a kicker at a bottom end and a handle at a top end thereof; and wherein the ejector comprises a first protrusion and a second protrusion for respectively engaging with a first bar and a second bar arranged on the sidewall, the first and the second protrusions passing by the bars during rotation of the ejector, and wherein the first and the second protrusions are of trapezoid shape including a slanted surface facing to the central slot, and the first protrusion is smaller than the second protrusions.

9. The card edge connector as claimed in claim 8, wherein the first protrusion is arranged on a lower end of the handle and the second protrusion is arranged on a middle portion of the main body.

10. The card edge connector as claimed in claim 8, wherein the sidewall further includes a third bar parallel to the first bar and mating with the first protrusion.

11. The card edge connector as claimed in claim 8, wherein first protrusion is received in a recess defined on the sidewall, and the second protrusion is received in the receiving space.

12. An electrical connector comprising:

an elongated insulative housing defining a central slot extending along a longitudinal direction;

a plurality of contacts disposed in the housing by two sides of the central slot;

a pair of towers located at two opposite ends of the housing; and a protrusion is formed on a face of one of the ejector and the corresponding tower, and a pair of recesses are formed in another face of the other of the ejector and the corresponding tower under a condition that said another face intimately confronts said face so that when the ejector is rotated to a mediate position between an innermost position to and outermost position, the ejector experiences a rest in the tower by engagement between the protrusion and one of said recesses.

13. The electrical connector ad claimed in claim 12, wherein the protrusion is formed on the ejector, and the pair of recesses are formed in the tower.

* * * * *